US005961007A

United States Patent [19]

Dornbusch et al.

[11] Patent Number: 5,961,007

[45] Date of Patent: Oct. 5, 1999

[54] DISPENSING PACKAGE

[75] Inventors: Arthur Harold Dornbusch; John Robert Davis, both of Cincinnati, Ohio

[73] Assignee: The Procter & Gamble Company, Cincinnati, Ohio

[21] Appl. No.: 09/094,787

[22] Filed: Jun. 15, 1998

[51] Int. Cl.[6] ..... A45D 40/06

[52] U.S. Cl. ..... 222/386; 222/390; 401/68; 401/175

[58] Field of Search ..... 222/380, 390; 401/68, 75, 175, 171, 172, 174, 176

[56] References Cited

U.S. PATENT DOCUMENTS

| | | | |
|---|---|---|---|
| Re. 34,751 | 10/1994 | Thompson | 401/175 |
| 3,178,074 | 4/1965 | Sundholm | 222/386 |
| 3,209,955 | 10/1965 | Sundholm | 222/390 X |
| 3,454,181 | 7/1969 | Riss et al. | 220/39 |
| 3,907,441 | 9/1975 | Idec et al. | 401/75 |
| 4,269,330 | 5/1981 | Johnson | 222/386 |
| 4,298,036 | 11/1981 | Horvath | 141/1 |
| 4,521,127 | 6/1985 | Tomburo et al. | 401/68 |
| 4,548,524 | 10/1985 | Seager | 401/187 |
| 4,580,920 | 4/1986 | Schmidt | 401/175 |
| 4,605,330 | 8/1986 | Crowley et al. | 401/68 |
| 4,621,935 | 11/1986 | Sussman | 401/82 |
| 4,645,098 | 2/1987 | Hoffmann | 222/386 |
| 4,664,547 | 5/1987 | Rosenwinkel | 401/175 |
| 4,702,399 | 10/1987 | Davis | 222/390 |
| 4,809,887 | 3/1989 | Jupin et al. | 222/207 |
| 4,813,801 | 3/1989 | Cardia | 401/71 |
| 4,915,528 | 4/1990 | Seager | 401/68 |
| 4,932,803 | 6/1990 | Goldberger et al. | 401/75 |
| 4,950,094 | 8/1990 | Yorks | 401/75 |
| 4,984,718 | 1/1991 | Cardia | 222/390 |
| 5,007,755 | 4/1991 | Thompson | 401/175 |
| 5,076,720 | 12/1991 | Roger | 401/75 |
| 5,127,556 | 7/1992 | Sporri | 222/386 X |
| 5,137,185 | 8/1992 | Mitchell | 222/390 |
| 5,181,790 | 1/1993 | Lucas | 401/75 |
| 5,401,112 | 3/1995 | Dornbusch et al. | 401/68 |
| 5,437,513 | 8/1995 | Favre | 401/68 |
| 5,445,465 | 8/1995 | Cardia | 401/175 |
| 5,505,041 | 4/1996 | Harlan | 401/68 X |
| 5,540,361 | 7/1996 | Fattori | 222/390 |
| 5,697,531 | 12/1997 | Fattori | 222/390 |
| 5,725,133 | 3/1998 | Iaia | 222/390 |
| 5,753,212 | 5/1998 | Pescatore et al. | 401/175 X |
| 5,839,622 | 11/1998 | Bicknell et al. | 222/390 |

FOREIGN PATENT DOCUMENTS

| | | |
|---|---|---|
| 196385 | 10/1986 | European Pat. Off. . |
| 0 787 445 A1 | 8/1997 | European Pat. Off. . |
| 2807-472 | 8/1979 | Germany . |
| 1427931 | 3/1976 | United Kingdom . |
| WO 8606-257 | 11/1986 | WIPO . |

*Primary Examiner*—Kevin P. Shaver
*Attorney, Agent, or Firm*—Jack L. Oney, Jr.

[57] ABSTRACT

A dispensing package for cosmetic creams is disclosed. The dispensing package includes a container body having a first end and a second end. The container body includes a first inner perimeter adjacent the first end and a second inner perimeter adjacent the second end, wherein the first perimeter is larger than the second perimeter. The dispensing package also includes an elevator positioned within the container body for movement between the second end of the container body and the first end of the container body to force material held within the container body out the first end of the container body. The elevator includes an outer surface facing an inner wall of the container body and a sealing bead formed on the outer surface of the elevator. The sealing bead engages the inner wall of the container body adjacent the second end of the container body to form a seal permitting filling of the dispensing package and containment of product volatiles during storage and distribution. The sealing bead disengages from the inner wall of the container body where the second inner perimeter transitions to the first inner perimeter to provide pressure relief from the seal and a free-floating elevator as the elevator moves from the second end of the container body toward the first end of the container body.

23 Claims, 3 Drawing Sheets

DISPENSING PACKAGE

FIELD OF THE INVENTION

This invention relates to swivel-up dispensing packages, and more particularly, to swivel-up dispensing packages exhibiting a pressure relief dosing and delivery system, and a free-floating elevator which is suitable for liquid filling.

BACKGROUND OF THE INVENTION

Swivel-up dispensing packages have been used to dispense cosmetic cream products to the axillae of the user. Typically, the product is moved to the outer end of the dispensing package by manually turning a hand wheel, which drives a feed screw and, in turn, an elevator. Moving the elevator into the product pressurizes the product causing the product to be extruded through the orifices of a perforated dome onto the applicating surface of the perforated dome.

An undesirable side effect of this type of dispensing package which occurs when cream products are used is that after the product has been dispensed there exists residual pressure within the product in the dispensing package against the perforated dome causing the product to weep onto the applicating surface of the perforated dome for a period of time after the user has ceased dispensing. Depending upon the material properties of the cream product contained in the dispensing package, product separation may occur and individual components of the cream product could spread onto the applicating surface. Either occurrence results in a soiled, undesirable appearance of the applicating surface and may also negatively affect application aesthetics. Furthermore, after the product and/or its components, have weeped (defined as a liquid component separating from a product's chemical or physical matrix) onto the applicating surface, the product, or its components, may spread to the outer wall of the container body and soil the hands of the user.

One approach to relieving the residual pressure on the product is to utilize a dispensing package having a feed screw to drive an elevator which impels the cream product in a unidirectional manner. The drive of the feed screw is superimposed with reciprocatory motion caused by an internal cam. When the feed screw moves up the internal cam the pressure on the product increases and product extrusion through the perforated dome occurs. An integral spring or a separate spring can be used on the feed screw to retract the feed screw and elevator once the internal cam has reached its apex position. It is important to have the elevator surface match the internal topography of the perforated dome and to have the elevator move perpendicular to the feed screw without wobbling (defined as teetering or moving unsteadily in an orientation which is not perpendicular to the feed screw within the dispensing package as measured by a suitable angle measure or deflection gauge) so that the pressure on the product during extrusion is uniform. By intermittently retracting the elevator a suitable distance, discrete amounts of the product (doses) are dispensed for each cycle and the residual pressure on the product is relieved, preventing it from weeping onto the applicating surface of the dispensing package. Dispensing packages in accordance with this method are discussed in detail in U.S. Pat. No. 5,000,356 to Johnson et al., which is incorporated herein by reference.

One of the most common methods for filling cosmetic cream into a swivel-up dispensing package is to pour the cosmetic cream as liquid into the opened top end of the dispensing package. Unfortunately, the cosmetic cream in liquid form often undesirably leaks past the elevator. One method to fix this problem is to provide a seal bead completely surrounding the elevator. However, when this method is used the interference between the seal bead and the inner walls of the dispensing package is substantial and results in partial or no retraction of the elevator as discussed in U.S. Pat. No. 5,000,356 to Johnson et al. When a seal bead completely surrounding the elevator is not used, the elevator is now free-floating (experiencing minimal contact pressure with inner wall of the container body thus allowing the elevator to be retractable) but tends to lose its proper orientation of being perpendicular to the feed screw within the dispensing package during use. When the elevator is not properly oriented within the dispensing package, the product is dispensed non-uniformly and the pressure of the product against the perforated dome is not uniform thus resulting in non-uniform pressure relief by the elevator and weeping of the product.

It is, therefore, desirable to provide a dispensing package having a sealing system which effectively seals the dispensing package to prevent leakage during filling of the product from the top, while also providing a free-floating elevator which responds to the retracting action of the feed screw to prevent weeping of product onto the applicating surface while achieving proper orientation of being perpendicular to the feed screw within the dispensing package during use.

SUMMARY OF THE INVENTION

It is, therefore, an object of the present invention to provide a dispensing package including a container body having a first end and a second end. The container body includes a first inner perimeter adjacent the first end and a second inner perimeter adjacent the second end, wherein the first perimeter is larger than the second perimeter. The dispensing package also includes an elevator positioned within the container body for movement between the second end of the container body and the first end of the container body to force material held within the container body out the first end of the container body. The elevator includes an outer surface facing an inner wall of the container body and a sealing bead formed on the outer surface of the elevator. The sealing bead engages the inner wall of the container body adjacent the second end of the container body to form a seal permitting filling of liquid product into the dispensing package as well as containment of product volatiles during storage and distribution. The sealing bead disengages from the inner wall of the container body where the second inner perimeter transitions to the first inner perimeter to provide a free-floating elevator as the elevator moves from the second end of the container body toward the first end of the container body.

It is also an object of the present invention to provide a dispensing package wherein the elevator includes at least one upwardly and outwardly extending fin (defined as outwardly extending member) projecting from an edge of an upper surface of the elevator.

It is a further object of the present invention to provide a dispensing package wherein the elevator includes an elevator major axis and an elevator minor axis and the container body includes a container body major axis and a container body minor axis, and wherein first and second fins respectively project from first and second edges of the upper surface of the elevator along the elevator major axis.

It is also an object of the present invention to provide a dispensing package wherein the container body includes a thickened portion adjacent the second end of the container body to create the smaller inner perimeter adjacent the second end of the container body. The sealing bead which surrounds the elevator engages the thickened portion to form the seal and moves above the thickened portion as the elevator moves toward the first end of the container body to readily provide a free-floating elevator as the elevator moves toward the first end of the container body.

It is a further object of the present invention to provide a dispensing package wherein the sealing bead forms a compression seal with the inner wall of the container body adjacent the second end of the container body.

It is another object of the present invention to provide a dispensing package wherein the first and second fins form a 1:1 contact (defined as minimal force of interference contact) with the inner wall of the container body.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
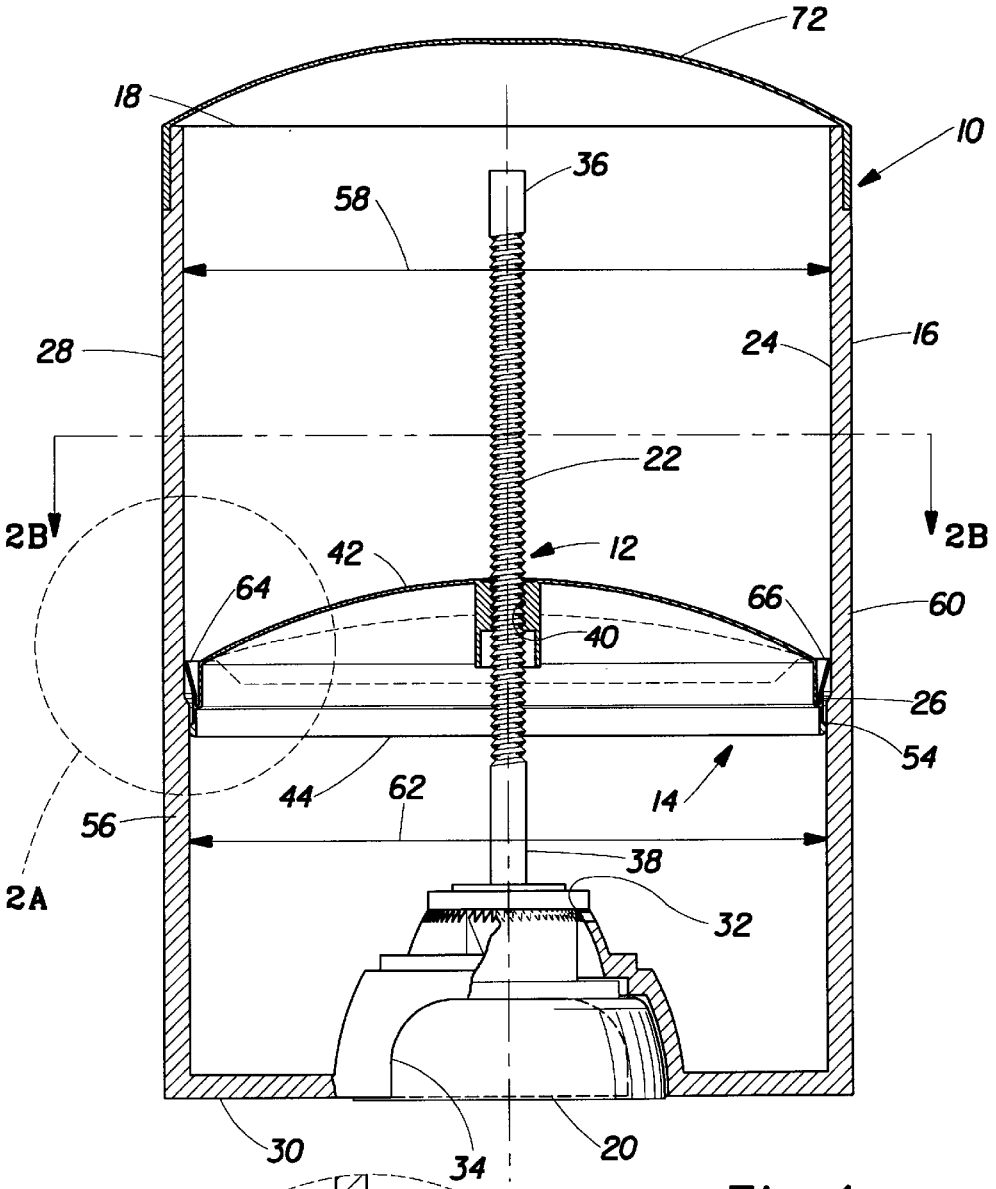
FIG. 1 is a longitudinal-sectional view of the present dispensing package with the elevator in its fully retracted position.

With reference to FIGS. 1 through 6, a dispensing package 10 is disclosed. The dispensing package 10 is a screw dispensing package commonly used in applying deodorant, and other materials. The dispensing package employs a pressure relief screw mechanism 12 to move an elevator 14 within a container body 16 and force material from the first end 18 of the container body 16. The pressure relief screw mechanism 12 is preferably similar to that disclosed in U.S. Pat. No. 5,000,356 to Johnson et al., although other pressure relief screw mechanisms could be employed without departing from the spirit of the present invention.

Figure 5:
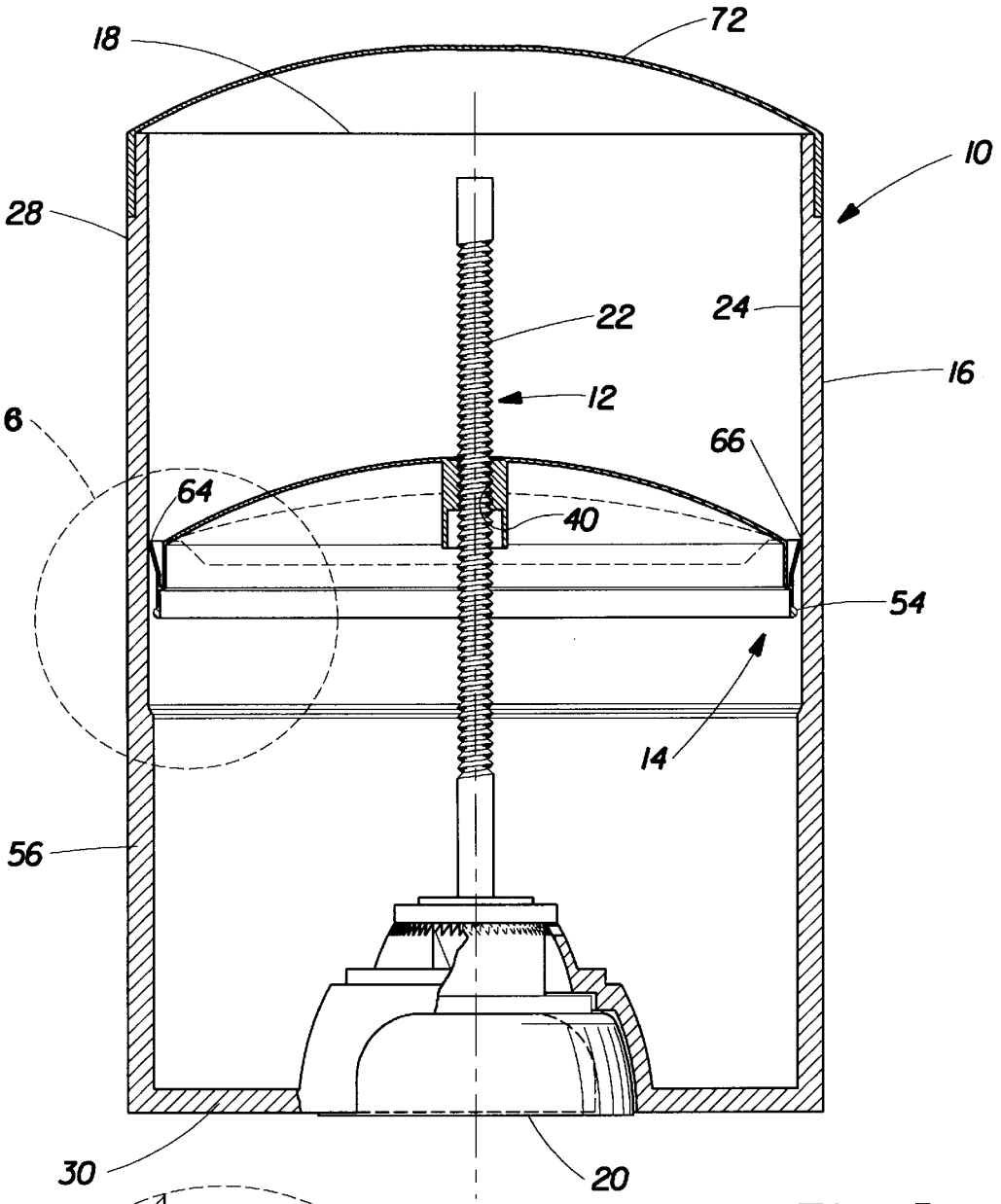
FIG. 5 is a longitudinal-sectional view of the dispensing package with the elevator moved above the thickened portion of the container body wall.

Briefly, and with reference to FIGS. 1 and 5, the screw mechanism 12 is actuated by rotating a hand wheel 20 coupled to a feed screw 22 and the elevator 14. In use, the hand wheel 20 is rotated, thereby rotating the feed screw 22. Since the elevator 14 is housed within the container body 16, rotation of the feed screw 22 causes the elevator 14 to move up the feed screw 22, thus forcing material from the dispensing package 10 when the hand wheel 20 is rotated to cause the elevator 14 to move upwardly.

In accordance with the preferred embodiment of the present invention, the dispensing package 10 includes a container body 16 in which the material is stored, an elevator 14 used to force the material from within the container body 16, and a screw mechanism 12 controlling the movement of the elevator 14 within the container body 16. The container body 16 is preferably constructed from polypropylene and the elevator 14 is preferably constructed from polyethylene. The use of these materials in constructing the container body 16 and elevator 14 achieves a smooth sliding interaction between the inner wall 24 of the container body 16 and the outer surface 26 of the elevator 14. However, other materials could be employed without departing from the spirit of the present invention.

Figure 2A:
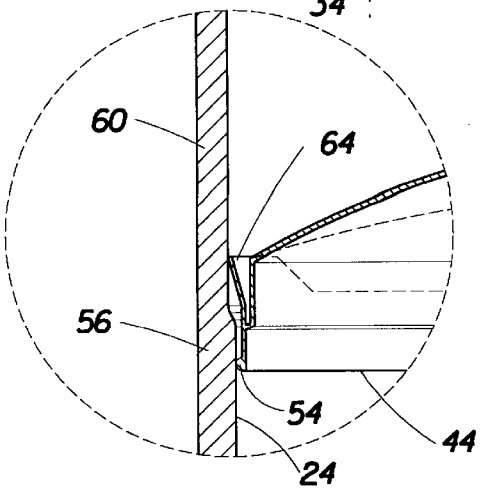
FIG. 2A is a detailed longitudinal-sectional view of the dispensing package with the elevator in its fully retracted position as highlighted by the circle 2A shown in FIG. 1.
Figure 2B:
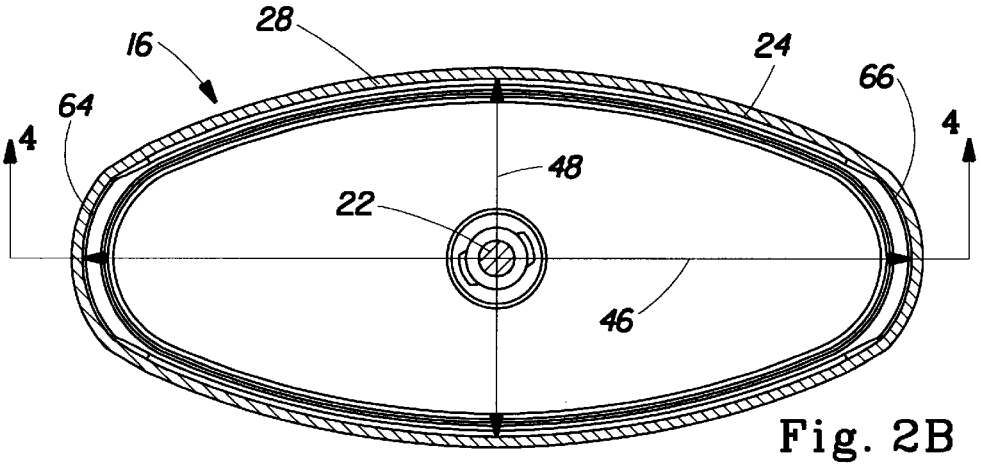
FIG. 2B is a cross-sectional view of the container body with elevator along the line 2B—2B as shown in FIG. 1.
Figure 3:
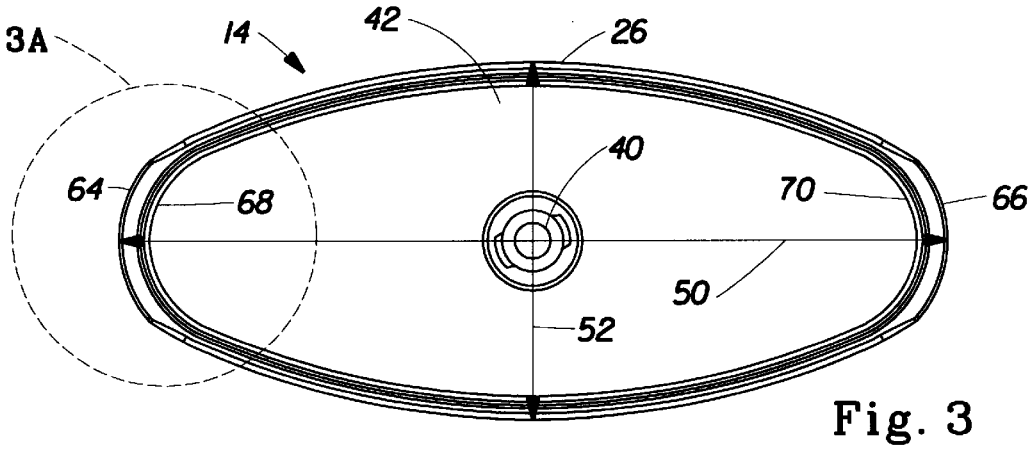
FIG. 3 is a top view of the elevator.
Figure 3A:
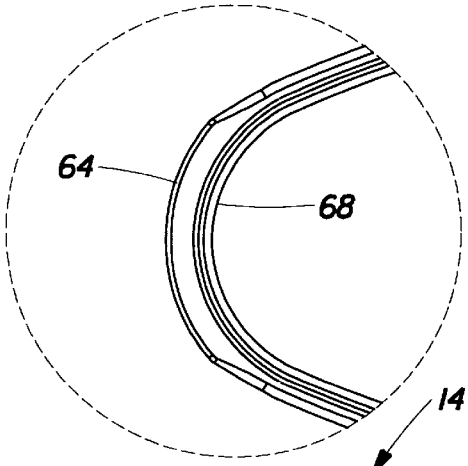
FIG. 3A is a detailed top view of the elevator highlighted by the circle 3A as shown in FIG. 3.
Figure 4:
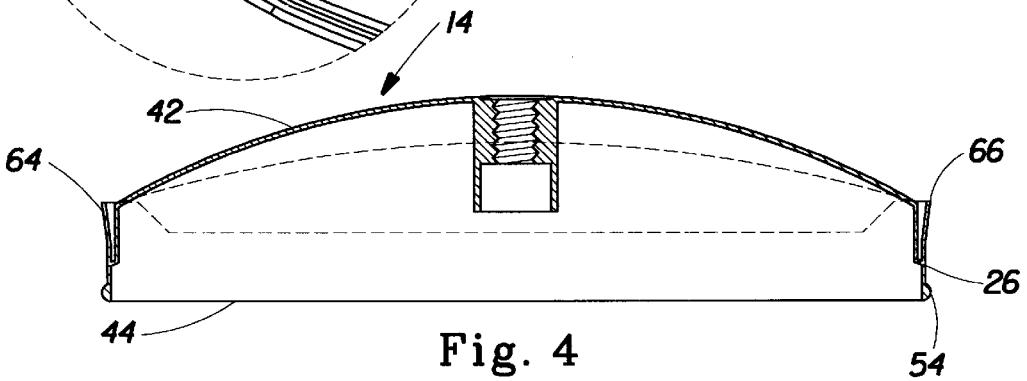
FIG. 4 is a longitudinal-sectional view of the elevator along the line 4—4 as shown in FIG. 2B.

With reference to FIGS. 1 and 2B, the container body 16 is commonly oval shaped in the cross-section, although other shapes could be employed without departing from the spirit of the present invention such as rectangular, circular, elliptical, triangular, and square. Container body 16 is preferably constructed from a single piece of plastic and includes a first end 18 through which the material is dispensed, elongated side walls 28, and a substantially closed second end 30. Container body 16 may also be constructed from multiple pieces of plastic. The second end 30 includes an opening 32 sized and shaped to accommodate the screw mechanism 12 in a manner that will be discussed in greater detail below.

The screw mechanism 12 is a conventional actuating system used in similar dispensing devices. Briefly, the screw mechanism 12 preferably used in accordance with the present invention includes a rotatable hand wheel 20 and a threaded feed screw 22 secured to the rotatable hand wheel 20 for rotation therewith. The hand wheel 20 is held within a recess 34 formed externally of the second end 30 of the container body 16. The recess 34 is formed to house the hand wheel 20 therein, while permitting a user to engage and rotate the hand wheel 20 when the user desires to dispense the material.

The feed screw 22 has a first end 36 and a second end 38. The second end 38 of the feed screw 22 extends through the opening 32 in the second end 30 of the container body 16 and is coupled to the hand wheel 20. In this way, the feed screw 22 is rotated when the hand wheel 20 is rotated by a user. The first end 36 of the feed screw 22 extends within the container body 16 such that the elevator 14 may ride on the feed screw 22 until it reaches a desired position adjacent the first end 18 of the container body 16.

As such, the elevator 14 includes a threaded central opening 40 shaped and sized to receive the feed screw 22. Since the elevator 14 is shaped to snugly fit within the container body 16, the elevator 14 does not rotate within the container body 16 and rotation of the feed screw 22 causes the elevator 14 to ride up on the feed screw 22.

In use, the hand wheel 20 and feed screw 22 are rotated by the user when he or she desires additional material to be forced from the first end 18 of the container body 16. When the hand wheel 20 and feed screw 22 are rotated in the appropriate direction, the elevator 14 is moved toward the first end 18 of the container body 16. Movement of the elevator 14 toward the first end 18 of the container body 16 moves the stored material in a similar direction, and the material is ultimately forced out of the first end 18 of the container body 16 for use by the individual. Since the present dispensing package 10 employs a pressure relief screw mechanism 12, the elevator 14 is slightly retracted after the material is forced from the container body 16 to prevent additional material from weeping from the dispensing package 10.

The elevator 14 of the present dispensing package 10 works in conjunction with the inner wall 24 of the container body 16 to seal the space between the outer surface 26 of the elevator 14 and the inner wall 24 of the container body 16. When the space between the outer surface 26 of the elevator 14 and the inner wall 24 of the container body 16 is properly sealed in accordance with the present invention, the dispensing package 10 may be filled with the material in liquid form (that is, liquid filling of the dispensing package). In addition, a proper seal in accordance with the present invention contains the material's volatiles during storage and/or distribution of the filled dispensing package.

However, the seal created between the sealing bead 54 of the elevator 14 and the inner wall 24 of the container body 16 is broken after the liquid product has solidified and the elevator 14 is moved toward the first end 18 of the container body 16. In this way, the present dispensing package 10 provides a freely floating elevator 14 ideally designed for use with a pressure relief dispensing package.

Specifically, the elevator 14 is provided with an upper surface 42 facing the first end 18 of the container body 16 and a lower surface 44 facing the second end 30 of the container body 16. The upper surface 42 provides a support surface upon which the material sits while it moves within the container body 16. Upper surface 42 having a contour which matches the internal topography of perforated dome 72 in order to achieve uniform internal pressure between the product and perforated dome 72 during use of dispensing package. The elevator 14 also includes an outer surface 26 between the upper surface 42 and the lower surface 44. The outer surface 26 of the elevator 14 is designed to move adjacent the inner wall 24 of the container body 16 as the elevator 14 moves within the container body 16 to dispense the material therefrom. As such, the outer surface 26 of the elevator 14 is shaped to conform to the inner wall 24 of the container body 16. Since the container body 16 is commonly oval shaped and includes a major axis 46 and a minor axis 48, the elevator 14 is similarly oval shaped and includes a major axis 50 and a minor axis 52.

The formation of a secure seal between the outer surface 26 of the elevator 14 and the inner wall 24 of the container body 16 is achieved by the provision of a sealing bead 54 along the outer surface 26 of the elevator 14 adjacent the lower surface 44 of the elevator 14, as best shown in FIG. 2A. The sealing bead 54 works in conjunction with a thickened portion 56 of the container body 16 to form a secure seal permitting the filling of liquid product into the dispensing package 10.

Accordingly, the container body 16 includes a first inner perimeter 58 along the first end 18 and the central section 60 of the container body 16 and a second inner perimeter 62 adjacent the second end 30 of the container body 16 (that is, a thickened portion), wherein the first inner perimeter 58 is slightly larger than the second inner perimeter 62. The second inner perimeter 62 is created by forming the container body 16 such that the wall of the container body 16 is thicker adjacent the second end 30 of the container body 16. In accordance with the preferred embodiment of the present invention, the wall of the container body 16 adjacent the second end 30 of the container body 16 is approximately 0.003" to approximately 0.005" thicker than the wall of the container body 16 adjacent the first end 18 of the container body 16. While the inner perimeter of the container body 16 is controlled by adjusting the thickness of the wall of the container body 16 in the disclosed embodiment, the inner perimeter of the container body 16 may be controlled in other ways without departing from the spirit of the present invention.

The sealing bead 54 of the elevator 14 is shaped and dimensioned to securely engage the thickened portion 56 of the container body 16 when the elevator 14 is in its fully retracted position adjacent the second end 30 of the container body 16 (see FIGS. 1 and 2A). The sealing bead 54 extends approximately 0.015" from the outer surface 26 of the elevator 14. In this way, the sealing bead 54 forms a compression seal with the inner wall 24 of the container body 16 at the thickened portion 56 of the container body 16 to seal the space between the outer surface 26 of the elevator 14 and the inner wall 24 of the container body 16. As container body 16 is used overtime, sealing bead 54 sets to the shape and dimensions of the inner wall 24 of the container body 16.

When the elevator 14 is in its fully retracted position, and the sealing bead 54 forms a compression seal with the thickened portion 56 of the container body 16, the dispensing package 10 may be filled with the material in a conventional manner, without worries that the material will leak between the outer surface 26 of the elevator 14 and the inner wall 24 of the container body 16. In summary, the elevator 14 and sealing bead 54 are shaped such that the sealing bead 54 engages the inner wall 24 of the container body 16 adjacent the second end 30 of the container body 16 to form a seal permitting liquid filling of the dispensing package, as well as containment of the material's volatiles during storage and distribution.

When a consumer desires to use the dispensing package 10, he or she first moves the sealing bead 54 above the thickened portion 56 of the container body 16 as the elevator 14 moves toward the first end 18 of the container body 16. That is, the sealing bead 54 quickly disengages from the inner wall 24 of container body 16 where the second inner perimeter 62 transitions to the first inner perimeter 58 to provide a free-floating elevator 14 ideally suited for use with a pressure relief dispensing package (see FIGS. 5 and 6). The height and gradient of the transition of inner wall 24 from the second inner perimeter 62 to the first inner perimeter 58 is critical in defining the engaging/disengaging relationship between the sealing bead 54 and inner wall 24. The preferred angle of the transition of inner wall 24 from the second inner perimeter 62 to the first inner perimeter 58 is about 3 degrees to about 10 degrees from horizontal.

As FIG. 1 shows, the sealing bead 54 only slightly engages the thickened portion 56. As a result, only limited pressure must be applied before the elevator 16 is moved toward the first end 18 of the container body 16, and the sealing bead 54 is moved above the thickened portion 56. It is important, however, that sealing bead 54 is not placed at a position too far down into thickened portion 56 of container body 16 because the internal force applied from the inner wall 24 onto sealing bead 54 may not allow elevator 14 to move upward into central section 60 and would result in damage to the internal cam 74.

Figure 6:
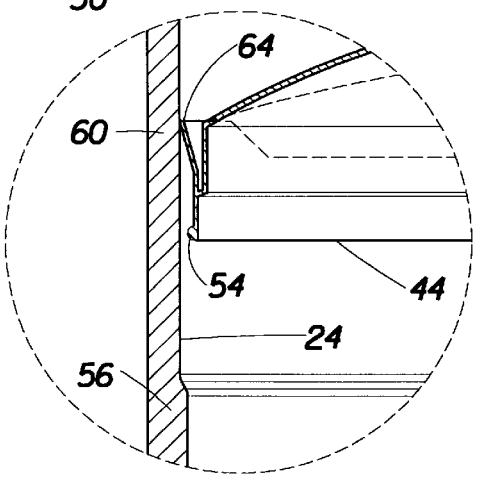
FIG. 6 is a detailed longitudinal-sectional view of the dispensing package with the elevator moved above the thickened portion of the container body wall as highlighted by the circle 6 shown in FIG. 5.

Once the sealing bead 54 moves above the thickened portion 56 of the container body 16, the sealing bead 54 remains set to the shape and dimensions of the thickened portion 56, and does not contact the inner wall 24 of the container body 16 as the elevator moves through the central section 60 and the first end 18 of the container body 16 (see FIGS. 5 and 6). In this way, the present invention provides a free-floating elevator 14.

Movement of the elevator 14 within the container body 16 is enhanced by the provision of first and second upwardly and outwardly extending fins 64, 66 projecting from the edge of the upper surface 42 of the elevator 14 toward the first end 18 of the container body 16. The provision of the fins 64, 66 enhances the movement of the elevator 14 within the container body 16 by restricting wobbling, of the elevator 14 within the container body 16.

The fins 64, 66 project from the first and second edges 68, 70 of the upper surface 42 of the elevator 14 along the major axis 50 of the elevator 14. Specifically, the fins 64, 66 project from the edges 68, 70 of the upper surface 42 along the outer surface of the elevator 14 to a position which is slightly inside the point at which the radius of the major axis 50 intersects the radius of the minor axis 52. The fins 64, 66 are designed to extend this limited distance to prevent pinching of the fins, causing the fins to buckle in an undesirable manner. In addition, by placing the fins 64, 66 along only a portion of the edges 68, 70 of the upper surface 42, the resistance created by the fins 64, 66 is limited without sacrificing the functionality of the fins 64, 66. If the resistance created by the fins 64, 66 is too great, then elevator 14 may function improperly and screw mechanism 12 may become damaged.

The fins 64, 66 are angled and sufficiently thin to conform to the inner wall 24 of the container body 16 through the range of dimensional variations encountered in normal injection molding of both the container body 16 and the elevator 14. The fins 64, 66 form a uniform 1:1 contact with the inner wall 24 of the container body 16 (that is, the fins 64, 66 have the same dimensions as the inner wall 24, and need not be compressed by the inner wall 24; in this way the fins 64, 66 form a free-floating contact with the inner wall 24 of the container body 16). As a result of 1) the minimal contact area between the fins 64, 66 and the inner wall 24 of the container body 16, 2) the minimal angle of contact between fins 64, 66 and the inner wall 24 of the container body 16, and 3) the minimal thickness and sufficient flexibility of the fins 64, 66, the 1:1 contact between the fins 64, 66 and the inner wall 24 of the container body 16 is essentially free-floating and requires minimal force to achieve reciprocative motion. The height of elevator 14 may be adjusted to accommodate a change in dispensing package 10 height. For example, if dispensing package 10 height is increased, then the height of elevator 14 may need to be increased to prevent wobble of elevator 14 during use.

The effectiveness of the sealing bead 54 is enhanced by the provision of the fins 64, 66 discussed above. Specifically, the fins 64, 66 prevent wobble, thus, ensuring a secure seal between the sealing bead 54 and the thickened portion of the container body 16.

While the preferred embodiment has been shown and described, it will be understood that there is no intent to limit the invention by such disclosure, but rather, is intended to cover all modifications and alternate constructions falling within the spirit and scope of the invention as defined in the appended claims.

We claim:

1. A dispensing package, comprising:

a container body having a first end and a second end, the container body includes a first inner perimeter adjacent the first end and a second inner perimeter adjacent the second end, wherein the first inner perimeter is larger than the second inner perimeter; and an elevator positioned within the container body for movement between the second end of the container body and the first end of the container body to force material held within the container body out the first end of the container body, the elevator includes an outer surface, wherein the outer surface engages an inner wall of the container body adjacent the second end of the container body to form a seal, and the outer surface disengages from the inner wall of the container body where the second inner perimeter transitions to the first inner perimeter to provide substantially less interference between the elevator and second end of the container body as the elevator moves from the second end of the container body toward the first end of the container body.

2. The dispensing package according to claim 1, wherein the elevator further includes at least one fin projecting from the outer surface of the elevator.

3. The dispensing package according to claim 1, wherein the container body and the elevator are generally oval shaped.

4. The dispensing package according to claim 1, wherein the container body includes a thickened portion adjacent the second end of the container body to create the smaller inner perimeter adjacent the second end of the container body.

5. The dispensing package according to claim 1, wherein the container body includes a thickened portion adjacent the second end of the container body to create the smaller inner perimeter adjacent the second end of the container body, wherein the outer surface of the elevator includes a sealing bead which engages the thickened portion to form the seal and moves above the thickened portion as the elevator moves toward the first end of the container body to provide substantially less interference between the elevator and second end of the container body as the elevator moves from the second end of the container body toward the first end of the container body.

6. The dispensing package according to claim 1, further including a screw mechanism coupled to the elevator for selectively moving the elevator within the container body.

7. The dispensing package according to claim 5, wherein the sealing bead forms a compression seal with the inner wall of the container body adjacent the second end of the container body.

8. The dispensing package according to claim 1, wherein the elevator includes an upper surface facing the first end of the container body and a lower surface facing the second end of the container body, and wherein the elevator includes a sealing bead which is located adjacent the lower surface of the elevator.

9. The dispensing package according to claim 2, wherein the container body and the elevator are generally oval shaped, the elevator includes an elevator major axis and an elevator minor axis and the container body includes a container body major axis and a container body minor axis, and wherein at least one fin projects from the outer surface of the elevator along the elevator major axis.

10. The dispensing package according to claim 5, wherein the inner wall of the container body adjacent to the second end of the container body is approximately 0.003" to approximately 0.005" thicker than the inner wall of the container body adjacent to the first end of the container body.

11. The dispensing package according to claim 1, wherein the outer surface of the elevator forms a compression seal with the inner wall of the container body adjacent the second end of the container body.

12. A dispensing package, comprising:

a container body having a first end and a second end; an elevator positioned within the container body for movement between the second end of the container body and the first end of the container body to force material held within the container body out the first end of the container body, the elevator is shaped to conform to an inner wall of the container body and includes an elevator major axis and an elevator minor axis, the elevator includes an outer surface; and at least one fin which projects from the outer surface of the elevator only along the elevator major axis, the fin being shaped to engage the inner wall of the container body such that the elevator is restricted from wobble yet remains retractable.

13. The dispensing package according to claim 12, wherein the elevator includes a first fin and a second fin which project from the outer surface of the elevator along the elevator major axis.

14. The dispensing package according to claim 13, wherein first and second fins respectively project from a first and second edge of a upper surface of the elevator along the elevator major axis to a position inside the point at which a radius of the elevator major axis intersects a radius of the elevator minor axis.

15. The dispensing package according to claim 12, wherein the outer surface of the elevator includes a sealing bead which forms a compression seal with the inner wall of the container body adjacent the second end of the container body.

16. The dispensing package according to claim 1, wherein the height of the elevator may be adjusted to accommodate a change in the height of the dispensing package to prevent wobble of the elevator during use.

17. The dispensing package according to claim 15, wherein the height of the elevator may be adjusted to accommodate a change in the height of the dispensing package to prevent wobble of the elevator during use.

18. A dispensing package, comprising:

a container body having a first end and a second end, the container body includes a first inner perimeter adjacent the first end and a second inner perimeter adjacent the second end, wherein the first inner perimeter is larger than the second inner perimeter;

an elevator positioned within the container body for movement between the second end of the container body and the first end of the container body to force material held within the container body out the first end of the container body, the elevator includes an outer surface, wherein the outer surface engages an inner wall of the container body adjacent the second end of the container body to form a seal, and the outer surface disengages from the inner wall of the container body where the second inner perimeter transitions to the first inner perimeter to provide substantially less interference between the elevator and second end of the container body as the elevator moves from the second end of the container body toward the first end of the container body; and wherein the preferred angle of the transition of the inner wall from the second inner perimeter to the first inner perimeter is about 3 degrees to about 10 degrees from horizontal.

19. The dispensing package according to claim 18, wherein the elevator further includes at least one fin projecting from the outer surface of the elevator.

20. The dispensing package according to claim 18, wherein the container body includes a thickened portion adjacent the second end of the container body to create the smaller inner perimeter adjacent the second end of the container body.

21. The dispensing package according to claim 1, wherein the shape of the container body may varying consisting of rectangular, circular, elliptical, triangular, and square.

22. The dispensing package according to claim 12, wherein the shape of the container body may varying consisting of rectangular, circular, elliptical, triangular, and square.

23. The dispensing package according to claim 18, wherein the shape of the container body may varying consisting of rectangular, circular, elliptical, triangular, and square.

* * * * *